US011385667B2

(12) United States Patent
Koay et al.

(10) Patent No.: US 11,385,667 B2
(45) Date of Patent: Jul. 12, 2022

(54) LOW DROPOUT REGULATOR WITH NON-LINEAR BIASING AND CURRENT CLAMPING CIRCUIT

(71) Applicant: QUALCOMM Incorporated, San Diego, CA (US)

(72) Inventors: Kuan Chuang Koay, Singapore (SG); Hua Guan, San Diego, CA (US); YuFei Pan, Singapore (SG)

(73) Assignee: QUALCOMM Incorporated, San Diego, CA (US)

( * ) Notice: Subject to any disclaimer, the term of this patent is extended or adjusted under 35 U.S.C. 154(b) by 46 days.

(21) Appl. No.: 16/724,150

(22) Filed: Dec. 20, 2019

(65) Prior Publication Data

US 2020/0201373 A1 Jun. 25, 2020

Related U.S. Application Data

(60) Provisional application No. 62/783,883, filed on Dec. 21, 2018.

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ..... G05F 1/46–468; G05F 3/26
See application file for complete search history.

(56) References Cited

U.S. PATENT DOCUMENTS

| | | | | |
|---|---|---|---|---|
| 8,169,203 | B1 | 5/2012 | Vemula | |
| 9,766,643 | B1 | 9/2017 | Cai et al. | |
| 9,886,049 | B2 | 2/2018 | Qing et al. | |
| 2012/0262138 | A1* | 10/2012 | Srinivasan | G05F 1/575 323/279 |
| 2016/0056798 | A1* | 2/2016 | Chan | G05F 1/613 327/108 |
| 2019/0258283 | A1 | 8/2019 | Pishdad | |

FOREIGN PATENT DOCUMENTS

CN 107688366 A 2/2018

* cited by examiner

*Primary Examiner* — Peter M Novak
(74) *Attorney, Agent, or Firm* — Haynes & Boone, LLP

(57) ABSTRACT

An LDO regulator is provided that includes a bias circuit that generates a bias current having a non-linear relationship to an output current for the LDO regulator. The LDO regulator is also configured to clamp the output current.

19 Claims, 6 Drawing Sheets

LOW DROPOUT REGULATOR WITH NON-LINEAR BIASING AND CURRENT CLAMPING CIRCUIT

CROSS REFERENCE TO RELATED APPLICATIONS

This application claims the benefit of U.S. Provisional Application No. 62/783,883, filed Dec. 21, 2018, which is incorporated by reference herein.

TECHNICAL FIELD

This application relates to low dropout regulators, and more particularly to a low dropout regulator with non-linear biasing and current clamping.

BACKGROUND

To regulate an output voltage, a low dropout (LDO) regulator includes a pass transistor that functions as a variable resistor to convert an input voltage into a regulated output voltage. The pass transistor introduces a low-frequency pole in the frequency response of the LDO regulator. It is conventional to compensate for the low-frequency pole with a zero introduced by an output capacitor and the equivalent series resistance of the output capacitor. But such compensation schemes typically require a relatively expensive electrolytic output capacitor to keep the LDO regulator from oscillating.

SUMMARY

In accordance with a first aspect of the disclosure, a low dropout (LDO) regulator is provided that includes: a differential amplifier configured to generate an error signal on an output node responsive to a difference between a feedback signal and a reference signal. The LDO regulator further includes a clamped current mirror configured to mirror the output current for the LDO regulator into a clamped mirrored current and also includes a capacitor coupled to the output node. In addition, the LDO regulator includes a variable resistor in series with the capacitor, wherein the variable resistor is configured to vary a variable resistance responsive to the clamped mirror current.

In accordance with a second aspect of the disclosure, a low dropout (LDO) regulator is provided that includes: a differential amplifier having an output node, the differential amplifier being configured to drive an error signal on the output node responsive to a difference between a reference voltage and an output voltage for the LDO regulator. The LDO regulator also includes a bias circuit configured to generate a bias current that is proportional to an output current for the LDO regulator according to a first proportionality while the bias current is less than a threshold level and that is proportional to the output current for the LDO regulator according to a second proportionality while the bias current is greater than the threshold level. The LDO regulator further includes a capacitor coupled to the output node and also includes a variable resistor coupled to the capacitor, wherein the variable resistor is configured to change a variable resistance responsive to the bias current.

In accordance with a third aspect of the disclosure, a low dropout regulator is provided that includes: a clamped transconductor configured to transconduct an error voltage signal into a clamped transconductance current; an output capacitor; and a pass transistor configured to conduct an output current that is proportional to the clamped transconductor current to charge the output capacitor with an output voltage.

In accordance with a fourth aspect of the disclosure, a method for a low dropout (LDO) regulator is provided that includes generating a bias current proportionally to an output current for the LDO regulator according to a first proportionality while the output current is less than a threshold level. The method also includes generating the bias current proportionally to the output current according to a second proportionality while the output current is greater than the threshold level, where the second proportionality is less than the first proportionality. The method further includes adjusting a variable resistance of a resistor-capacitor (RC) circuit responsive to the bias current and also includes biasing an output node of a differential amplifier in the LDO regulator with the RC circuit.

These and other advantageous features may be better appreciated through the following detailed description.

BRIEF DESCRIPTION OF THE DRAWINGS

Embodiments of the present disclosure and their advantages are best understood by referring to the detailed description that follows. It should be appreciated that like reference numerals are used to identify like elements illustrated in one or more of the figures.

DETAILED DESCRIPTION

Figure 1:
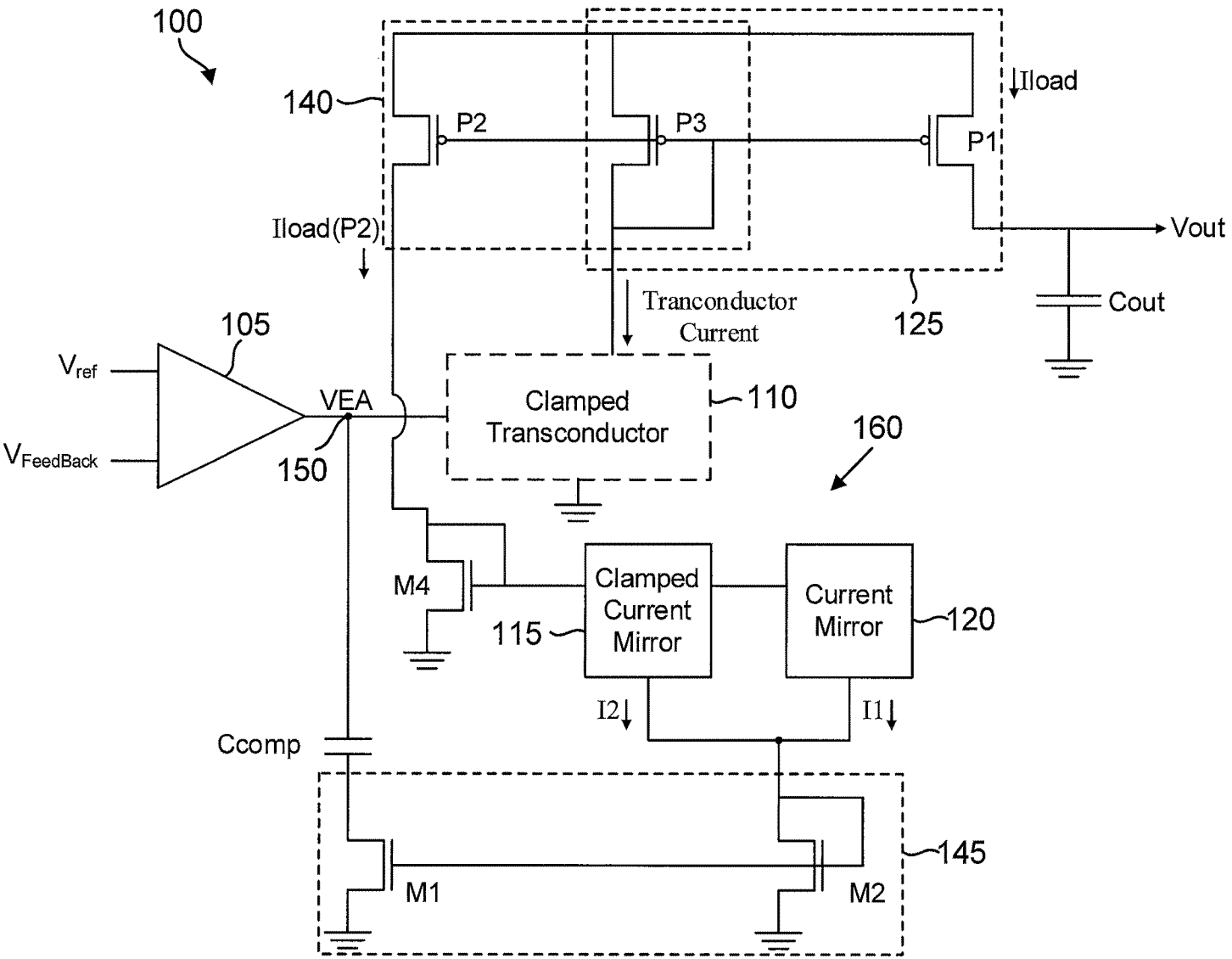
FIG. 1 is a circuit diagram of an LDO regulator in accordance with an aspect of the disclosure.

An LDO regulator is provided in which a feedback loop introduces a zero in the frequency response of the LDO regulator. The frequency of the zero has a non-linear relationship to the output current for the LDO regulator. To produce the non-linearity, the LDO regulator includes a bias circuit having two current mirrors that mirror the output current to produce a bias current. A first one of the current mirrors is a clamped current mirror that mirrors the output current into a clamped mirrored current. The clamped mirrored current varies in a linear fashion with the output current from a zero value up to a first clamped value. When the clamped mirrored current rises to its first clamped value in response to an increase in the output current to a threshold level, the clamped mirrored current is then clamped at the first clamped value regardless of whether the output current continues to increase above the threshold level. A second one of the current mirrors is a non-clamped current mirror that mirrors the output current into a (non-clamped) mirrored current. The mirrored current is proportional to the output current without any clamping. The clamped current and the non-clamped current are combined in the bias circuit to form the bias current. A variable resistor in a resistor-capacitor (RC) circuit varies its resistance responsive to the bias current. The RC circuit biases an output node of a differential amplifier in the LDO regulator. The output node of the differential amplifier is thus biased in a non-linear fashion responsive to the bias current. The resulting non-linear proportionality between the bias current and the output current is quite advantageous with respect to improving a phase margin for the LDO regulator.

The non-linear biasing from the bias current is not the only advantageous feature disclosed herein. In addition, note that at a power-up of the LDO regulator, its pass transistor will tend to pass a large amount of output current to raise the discharged output voltage towards its regulated value. The resulting output current can damage the pass transistor and other elements within the LDO regulator. To prevent this current rush such as during startup, the LDO regulator includes a clamped transconductor. To control the current from the clamped transconductor, the differential amplifier generates an error voltage signal responsive to a difference between a reference voltage and a feedback voltage derived from the output voltage. The clamped transconductor generates a transconductor current that is proportional to the error voltage signal until the error voltage signal reaches a threshold level at which point the clamped transconductor clamps the transconductor current to a second clamped value. An output current mirror that includes the pass transistor mirrors the transconductor current to form the output current for the LDO regulator. Since the output current is proportional to the transconductor current, the output current is clamped at a third clamped value when the transconductor current is clamped at the second clamped value. The relative magnitudes of the second clamped value and the third clamped value depends upon the proportionality within the output current mirror.

Turning now to the drawings, an example LDO regulator 100 is shown in FIG. 1. A differential amplifier 105 generates an error voltage signal (VEA) responsive to a difference between a reference voltage Vref and a feedback voltage VFeedback. A voltage divider (not illustrated) divides an output voltage Vout for LDO regulator 100 to form the feedback voltage. Alternatively, LDO regulator 100 may instead form the feedback voltage from the output voltage without any voltage division. The error voltage signal drives a clamped transconductor 110 to generate a transconductor current that is mirrored through an output current mirror 125 formed by a diode-connected p-type metal-oxide semiconductor (PMOS) transistor P3 and a PMOS pass transistor P1. Due to the action of output current mirror 125, an output current passed through pass transistor P1 is proportional to the transconductor current with a proportionality that depends on the relative sizes of diode-connected transistor P3 and pass transistor P1. Pass transistor P1 has a source connected to a power supply node for a power supply voltage VDD and a drain connected to an output capacitor Cout. The output current thus flows from the drain of pass transistor P1 to charge the output capacitor Cout with an output voltage Vout for LDO regulator 100. Diode-connected transistor P3 has a source connected to the power supply node and a drain and a gate connected to clamped transconductor 110 and also to a gate of pass transistor P1.

Figure 2:
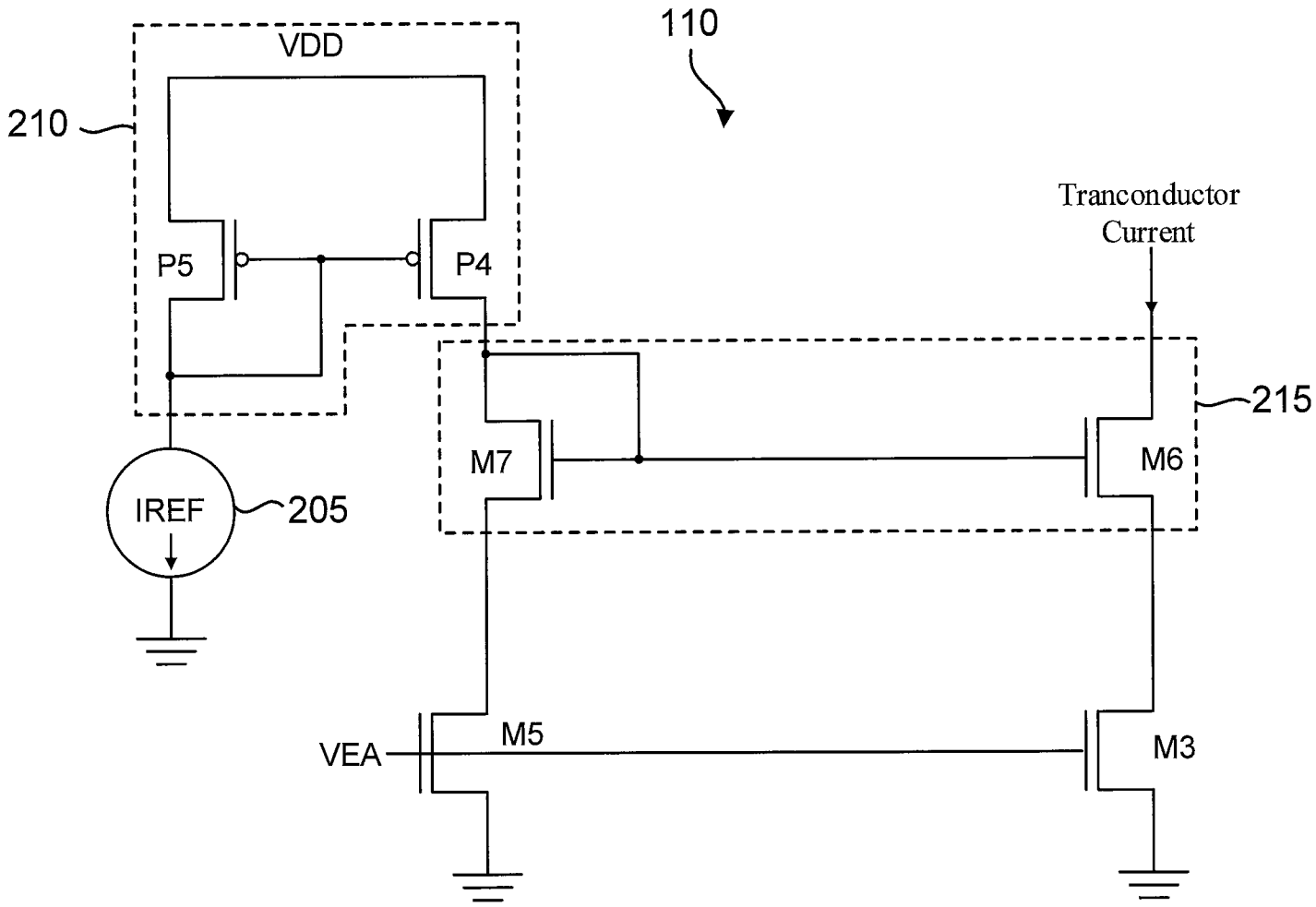
FIG. 2 is a circuit diagram of a clamped transconductor circuit in accordance with an aspect of the disclosure.

Clamped transconductor 110 is shown in more detail in FIG. 2. The error voltage signal (VEA) drives a gate of an n-type metal-oxide semiconductor (NMOS) transconductor transistor M3 having a source connected to ground and a drain connected to a source of an NMOS transistor M6. A drain of transistor M6 connects to a drain of diode-connected transistor P3 (FIG. 1). The error voltage signal VEA is thus transconducted by transconductor transistor M3 into a transconductor current according to the transconductance of transconductor transistor M3. The transconductor current flows through transistor M6 and diode-connected transistor P3 to be mirrored into the output current in output current mirror 125 as discussed with regard to FIG. 1.

To clamp the transconductor current (and thus clamp the output current), clamped transconductor 110 also includes a diode-connected PMOS transistor P5, a PMOS transistor P4, a diode-connected NMOS transistor M7, an NMOS transistor M5 and a current source 205 that conducts a first reference current (IREF). Transistor M5 has its source connected to ground and a gate driven by the error voltage signal. A drain of transistor M5 connects to a source of diode-connected transistor M7. A drain and a gate of diode-connected transistor M7 connect to a gate of transistor M6 and to a drain of transistor P4. A source of transistor P4 connects to a power supply node for the power supply voltage VDD. A source of diode-connected transistor P5 also connects to the power supply node. A drain of diode-connected transistor P5 connects to ground through current source 205.

Diode-connected transistor P5 and transistor P4 form a reference current mirror 210. Since diode-connected transistor P5 is forced to conduct the first reference current from current source 205, transistor P4 would tend to conduct a current proportional to the first reference current with the proportionality determined by the relative sizes of diode-connected transistor P5 and transistor P4. In the following discussion, it will be assumed that this proportionality is 1:1 but it will be appreciated that the proportionality may be varied in alternative embodiments. With the proportionality being 1:1, transistor P4 would tend to conduct the first reference current. But the current through transistor P4 is also controlled by transistor M5 since transistor P4, diode-connected transistor M7, and transistor M5 are all in series. In turn, the current conducted by transistor M5 is controlled by the error voltage signal. For relatively-low levels of the error voltage signal, the current conducted by transistor M5 will be less than the first reference current that transistor P4 would otherwise conduct. A drain voltage for transistor P4 will then essentially equal the power supply voltage VDD since transistor P4 could source the first reference current but is forced to conduct less due to the relatively-low level of the error voltage signal. The drain voltage for transistor P4 is also the drain voltage for diode-connected transistor M7. With this drain voltage essentially equaling the power supply voltage VDD, both transistors M7 and M6 are forced into the triode region of operation and can thus be approximated as short circuits. With transistors M7 and M6 operating in the triode region, transconductor transistor M3 conducts the transconductor current according to its transconductance as controlled by the error voltage signal.

But as the error voltage signal rises, the current conducted by transistor P4 will rise until it equals the first reference current. The drain voltage of P4 will then drop below the power supply voltage VDD. This reduction in the drain voltage for diode-connected transistor M7 forces transistor M5 and transconductor M3 to enter the triode region of operation such that their drain voltages are essentially grounded. This grounding of the drain voltages for transistor M5 and transconductor transistor M3 causes diode-connected transistor M7 and transistor M6 to form a current mirror 215. The transconductor current is thus clamped proportionally to the first reference current according to a proportionality as determined by the relative sizes of diode-connected transistor M7 and transistor M6. For example, suppose transistor M6 is larger than diode-connected transistor M7 by a ratio of 10:1. The transconductor current is thus clamped at 10 times the first reference current in such an embodiment. It will be appreciated that other proportionalities may be implemented in alternative embodiments. Since the transconductor current is clamped and the output current is a mirrored version of the transconductor current, the output current is also clamped. This clamping is quite advantageous in preventing damage to pass transistor P1 and other devices in LDO regulator 100 from excessive currents.

Referring again to FIG. 1, LDO regulator 100 includes a current mirror 140 that shares diode-connected transistor P3 with output current mirror 125. To form current mirror 140, the gate of diode-connected transistor P3 connects to a gate of a PMOS transistor P2 having a source connected to the power supply node. Transistor P2 will thus conduct a replica output current Iload(P2) that is proportional to the output current (also designated as Iload) with a proportionality determined by the relative sizes of transistor P2, diode-connected transistor P3, and pass transistor P1. A drain for transistor P2 connects to a drain and gate of an NMOS diode-connected transistor M4 having a source connected to ground. Diode-connected transistor M4 will thus conduct the replica output current Iload(P2).

The replica output current is mirrored within a bias circuit 160 that includes a clamped current mirror 115 and an (unclamped) current mirror 120. Diode-connected transistor M4 is part of these two current mirrors but is shown separately in FIG. 1 for illustration clarity. Clamped current mirror 115 mirrors the replica output current Iload(P2) into a clamped mirrored current I2. Similarly, current mirror 120 mirrors the replica output current Iload(P2) into a mirrored current I1. The two mirrored currents I1 and I2 are combined in bias circuit 160 by flowing through a diode-connected NMOS transistor M2 that forms a current mirror 145 with an NMOS transistor M1. Diode-connected transistor M2 and transistor M1 both have their sources connected to ground. A drain of transistor M1 connects through a compensation capacitor Ccomp to an output node 150 for differential amplifier 105. Depending upon the proportionality within current mirror 145, transistor M1 conducts a compensating current that is proportional to the sum of clamped mirrored current I2 and mirrored current I1 and is thus ultimately proportional to the output current. However, this proportionality is non-linear due to the clamping of clamped mirrored current I2 as will be explained further herein. Transistor M1 acts as a variable resistor that in combination with compensation capacitor Ccomp forms a resistor-capacitor (RC) circuit to bias output node 150 of differential amplifier 105. This biasing has a non-linear relationship to the output current that advantageously compensates the frequency response of LDO regulator 100 with a robust phase margin. Differential amplifier 105 may also be denoted as an error amplifier.

Figure 3:
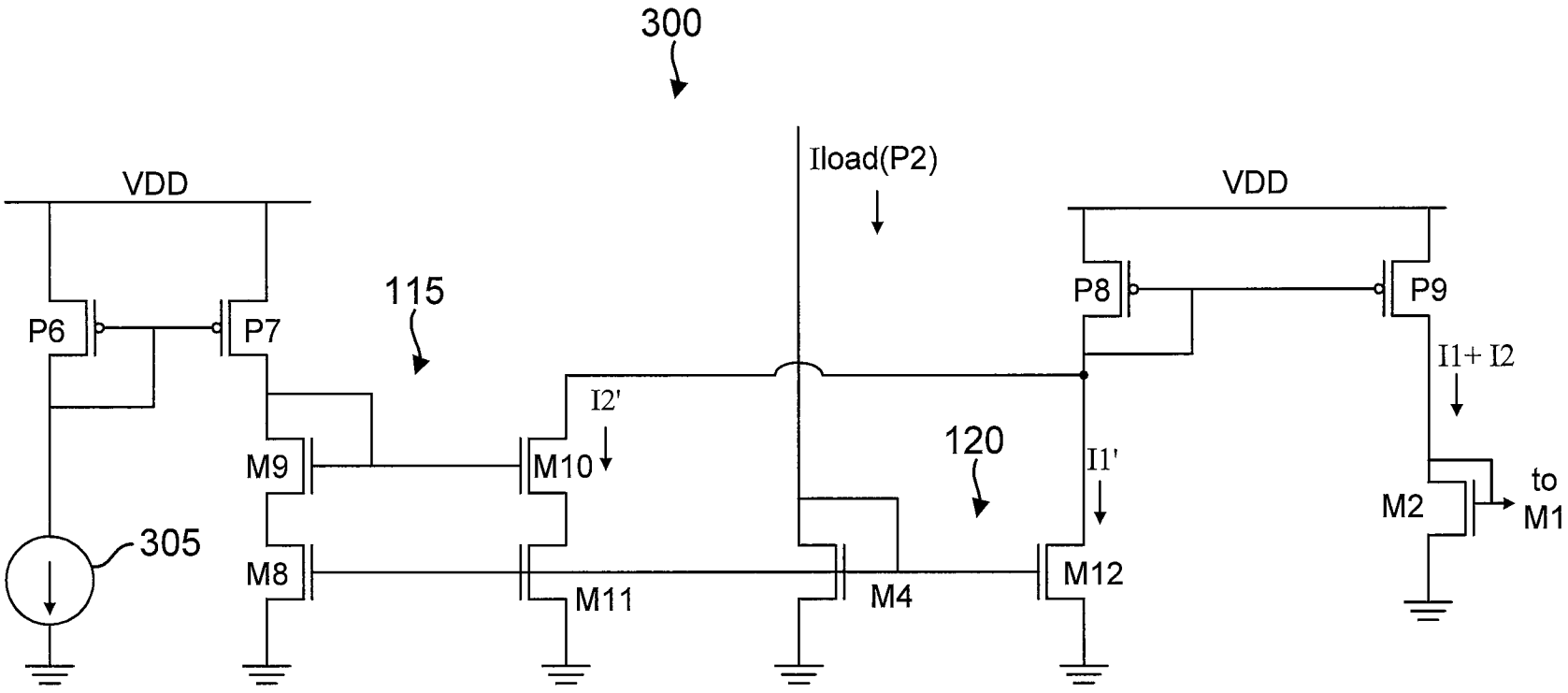
FIG. 3 is a circuit diagram of a clamped current mirror and an unclamped current mirror for generating a bias current in accordance with an aspect of the disclosure.

Clamped current mirror 115 and current mirror 120 are shown in more detail in FIG. 3. Clamped current mirror 115 includes a current source 305, a diode-connected PMOS transistor P6, a PMOS transistor P7, an NMOS diode-connected transistor M9, an NMOS transistor M8, an NMOS transistor M10, an NMOS transistor M11, and diode-connected transistor M4. The clamping within clamped current mirror 115 functions analogously as discussed with regard to clamped transconductor 110. In particular, a comparison of FIG. 3 with FIG. 2 will demonstrate that current source 305, diode-connected transistor P6, transistor P7, diode-connected transistor M9, and transistor M8 in clamped current mirror 115 are all arranged as discussed for corresponding current source 205, diode-connected transistor P5, transistor P4, diode-connected transistor M7, and transistor M5 in clamped transconductor 110. Similarly, an NMOS transistor M10 and an NMOS transistor M11 in clamped current mirror 115 correspond to the analogous arrangement of transistors M6 and M3 in clamped transconductor 110. A difference is that the gate voltage of diode-connected transistor M4 controls the gates of transistors M8 and M11 instead of the error voltage signal.

In clamped current mirror 115, a source of diode-connected transistor P6 and a source of transistor P7 are both connected to the power supply node for the power supply voltage VDD. A gate and a drain of diode-connected transistor P6 couple to ground through current source 305 and also couple to a gate of transistor P7. A drain of transistor P7 couples to a gate and to a drain of diode-connected transistor M9. A source of diode-connected transistor M9 couples to a drain of transistor M8. A source of transistor M8 couples to ground. Diode-connected transistor P6 and transistor P7 form a reference current mirror that is analogous to reference current mirror 210. A second reference current from current source 305 thus gets mirrored through diode-connected transistor P6 to cause transistor P7 to tend to conduct a mirrored version of the second reference current. But the replica output current Iload(P2) conducted by transistor M4 will also tend to be mirrored by transistors M8 and M11 so long as transistor M8 conducts less than the mirrored version of the second reference current. But as the current conducted by transistor M8 rises to equal the mirrored version of the second reference current, transistors M8 and M11 begin to operate in the triode region such that their drains are substantially grounded. These drain voltages in turn causes diode-connected transistor M9 and transistor M10 to function as a current mirror so that a current I2' conducted by transistor M10 is a mirrored version of the second reference current conducted by current source 305. A drain of transistor M10 connects to a drain of a diode-connected PMOS transistor P8 that forms a current mirror with a PMOS transistor P9. Transistor P9 thus conducts the clamped current I2 that has a proportionality to current I2' that depends upon the relative sizes of diode-connected transistor P8, transistor P9, and transistor M10.

Current mirror 120 is formed by diode-connected transistor M4 and an NMOS transistor M12. Transistor M12 thus conducts a mirrored version IP of the replica output current Iload(P2). A drain of transistor M12 connects to the drain and gate of diode-connected transistor P8. Transistor P9 will thus also conduct the mirrored current I1 that has a proportionality to mirrored current IP that depends upon the relative sizes of transistor M12, diode-connected transistor P8, and transistor P9.

Figure 4:
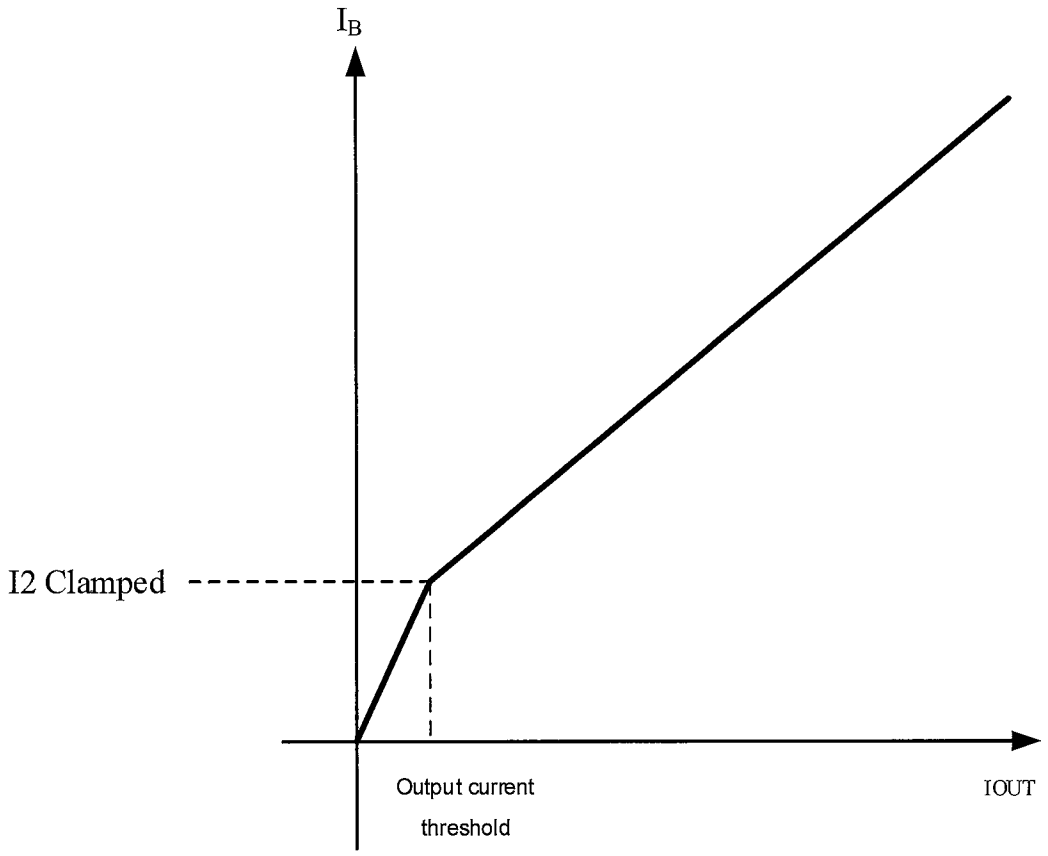
FIG. 4 is a plot of the bias current as a function of the output current in accordance with an aspect of the disclosure.

Mirrored current I1 is thus linearly proportional to the load current. Clamped mirrored current I2 is also linearly proportional to the load current until the clamped mirrored current I2 rises to its clamped value as set by the second reference current. A resulting bias current Ib that charges a gate of transistor M1 (FIG. 1) will have a non-linear dependence on the output current as shown in FIG. 4. As the output current increases from zero, the bias current Ib increases relatively rapidly as both current mirror 120 and clamped current mirror 115 are increasing their mirrored currents in response to the increase in the load current. But when the output current reaches a threshold level, the clamped mirrored current I2 reaches its clamped level (I2 clamped). The clamped mirrored current I2 then no longer increases with the output current. But the mirrored current I1 continues to increase linearly so the bias current has a non-linear profile for compensating the frequency response of LDO regulator 100 with an advantageously-enhanced phase margin.

Figure 5:
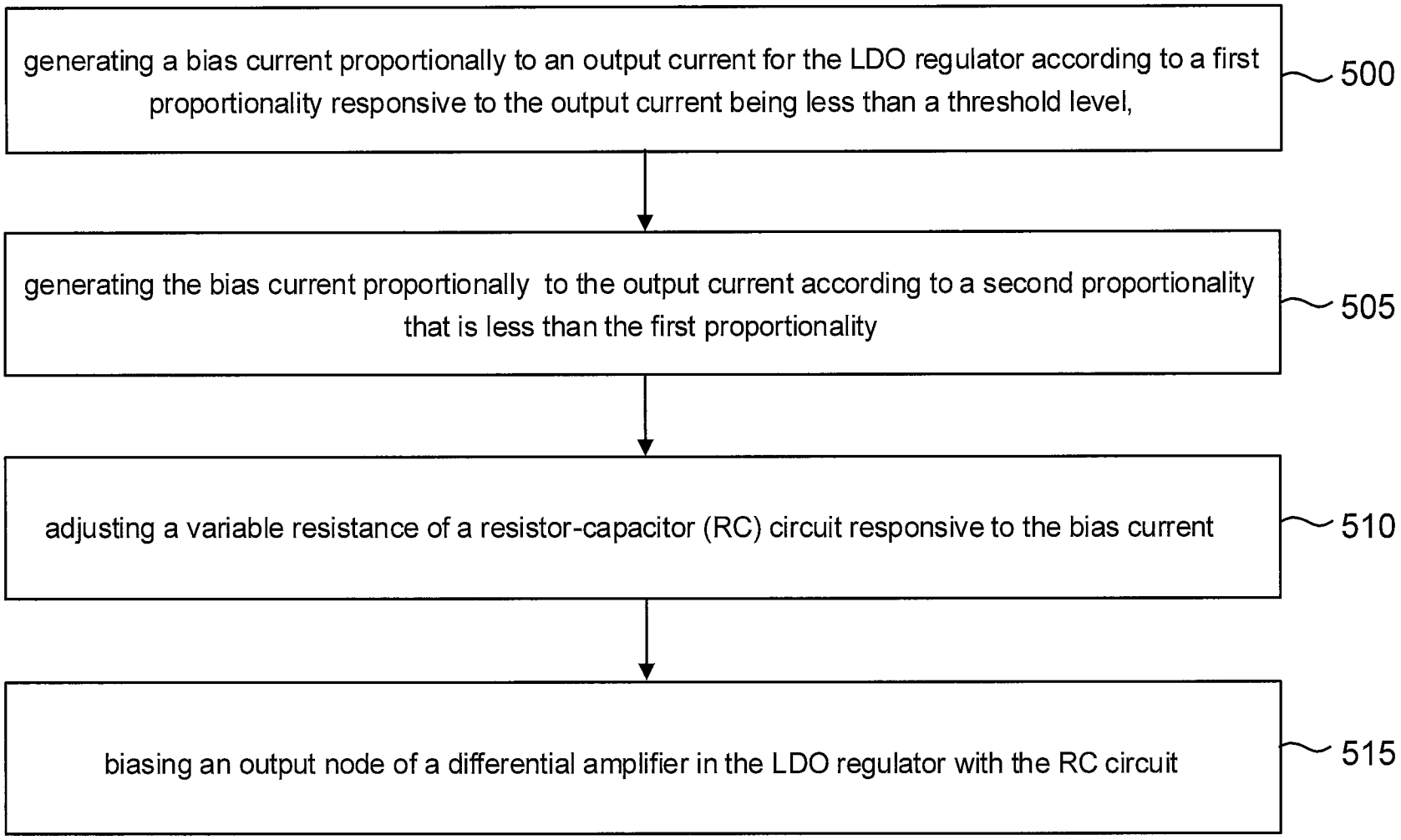
FIG. 5 is a flowchart for an example method in accordance with an aspect of the disclosure.

A method for compensating an LDO regulator as illustrated in the flowchart of FIG. 5 will now be discussed. The method includes an act 500 of generating a bias current proportionally to an output current for the LDO regulator according to a first proportionality while the output current is greater than a threshold level. Support for this act is shown in FIG. 4 in which the output current increases from zero to the threshold level at which point the clamped mirrored current I2 is clamped. The method also includes an act 505 of generating the bias current proportionally to the output current according to a second proportionality that is less than the first proportionality while the output current is greater than the threshold level. Support for act 505 is shown in FIG. 4 as the output current increases from its threshold level. In addition, the method includes an act 510 of adjusting a variable resistance of a resistor-capacitor (RC) circuit responsive to the bias current. An example of the RC circuit is given by the combination of transistor M1 and compensation capacitor Ccomp. Finally, the method includes an act 515 of biasing an output node of a differential amplifier in the LDO regulator with the RC circuit. An example of such an output node is output node 150.

In various embodiments, devices disclosed herein such as transistors and current sources disclosed herein may be referred to using the designations of first, second, third, and so on. The use of such designations is thus non-limiting such that in one context, a device may be referred to as a first device but another context may be referred to as a second device, and so on. In addition, it will be appreciated that the polarity of the various transistors disclosed herein may be varied so that what was a PMOS transistor may be implemented by an NMOS transistor in alternative embodiments and vice versa. In addition, it will also be appreciated that LDO regulator embodiments in accordance with the principles disclosed herein may be implemented with other types of transistors such as bipolar junction transistors.

Figure 6:
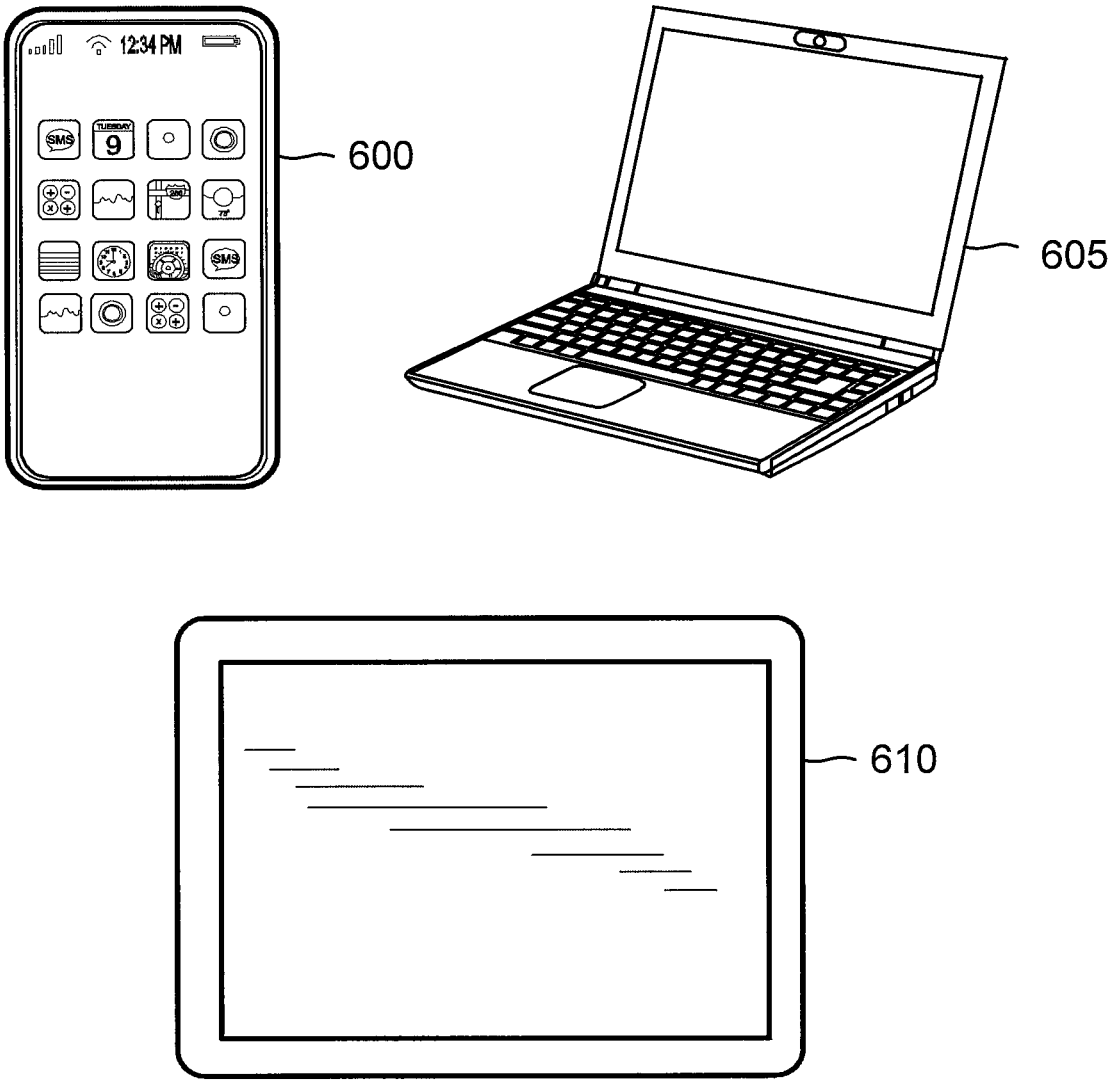
FIG. 6 illustrates some example electronic systems each incorporating an LDO regulator in accordance with an aspect of the disclosure.

An LDO regulator as disclosed herein may be advantageously incorporated in any suitable mobile device or electronic system. For example, as shown in FIG. 6, a cellular telephone 600, a laptop computer 605, and a tablet PC 610 may all include an LDO regulator in accordance with the disclosure. Other exemplary electronic systems such as a music player, a video player, a communication device, and a personal computer may also be configured with LDO regulators constructed in accordance with the disclosure.

It will be appreciated that many modifications, substitutions and variations can be made in and to the materials, apparatus, configurations and methods of use of the devices of the present disclosure without departing from the scope thereof. In light of this, the scope of the present disclosure should not be limited to that of the particular embodiments illustrated and described herein, as they are merely by way of some examples thereof, but rather, should be fully commensurate with that of the claims appended hereafter and their functional equivalents.

We claim:

1. A low dropout (LDO) regulator, comprising:

a differential amplifier configured to generate an error signal on an output node responsive to a difference between a feedback signal and a reference signal;

a clamped current mirror including a current source configured to source a reference current, wherein the clamped current mirror is configured to mirror an output current of the LDO regulator into a clamped mirrored current that is proportional to the output current responsive to the output current being less than a threshold value and that is proportional to the reference current responsive to the output current being greater than the threshold value;

a capacitor coupled to the output node; and a variable resistor in series with the capacitor and configured to vary a variable resistance responsive to the clamped mirrored current.

2. The LDO regulator of claim 1, wherein the differential amplifier is further configured to generate the error signal as an error voltage signal.

3. The LDO regulator of claim 2, further comprising:

a pass transistor configured to pass the output current responsive to the error voltage signal.

4. The LDO regulator of claim 2, further comprising:

a transconductor configured to transconduct the error voltage signal into a transconductor current; and an output current mirror including a pass transistor, wherein the output current mirror is configured to mirror the transconductor current into the output current.

5. The LDO regulator of claim 4, further comprising:

a first current mirror configured to mirror the transconductor current into a mirrored output current; and a second current mirror configured to mirror the mirrored output current into a mirrored current, wherein the variable resistor is further configured to vary the variable resistance responsive to a sum of the mirrored current and the clamped mirrored current.

6. The LDO regulator of claim 5, wherein the variable resistor is a transistor.

7. The LDO regulator of claim 6, wherein the transistor is an n-type metal-oxide semiconductor (NMOS) transistor having a source coupled to ground and a drain coupled to the capacitor.

8. The LDO regulator of claim 1, wherein the clamped current mirror further includes:

a reference current mirror configured to mirror the reference current into a mirrored reference current;

a first transistor;

a first diode-connected transistor configured to conduct the mirrored reference current through the first transistor;

a second transistor having a gate connected to the first diode-connected transistor;

a third transistor in series with the second transistor;

a second diode-connected transistor configured to conduct a mirrored version of the output current, wherein the second diode-connected transistor has a gate connected to a gate of the first transistor and to a gate of the third transistor, and wherein the second transistor and the third transistor are configured to conduct the clamped mirrored current.

9. A low dropout (LDO) regulator, comprising:

a differential amplifier having an output node, the differential amplifier being configured to drive an error voltage signal on the output node responsive to a difference between a reference voltage and a feedback voltage;

a bias circuit configured to generate a bias current that is proportional to an output current for the LDO regulator according to a first linear proportionality while the bias current is less than a threshold level and according to a second linear proportionality while the bias current is greater than the threshold level, wherein the second linear proportionality is less than the first linear proportionality, and wherein the bias circuit includes a diode-connected transistor configured to conduct the bias current;

a capacitor coupled to the output node; and a variable resistance transistor coupled to the capacitor and having a gate coupled to a gate of the diode-connected transistor.

10. The LDO regulator of claim 9, wherein the variable resistance transistor is an NMOS transistor having a source coupled to ground and a drain coupled to the capacitor, and wherein the diode-connected transistor has a source coupled to ground.

11. The LDO regulator of claim 9, further comprising:

a pass transistor configured to pass the output current responsive to the error voltage signal.

12. The LDO regulator of claim 11, further comprising:

a transconductor configured to transconduct the error voltage signal into a transconductor current; and a current mirror including the pass transistor, wherein the current mirror is configured to mirror the transconductor current into the output current.

13. A low dropout regulator, comprising:

a clamped transconductor including a first transistor and a current source configured to source a reference current, wherein the clamped transconductor is configured to transconduct an error voltage signal into a clamped transconductance current according to a transconductance of the first transistor while the error voltage signal is less than a threshold value and to clamp the clamped transconductance current at a clamped value while the error voltage signal is greater than the threshold value, and wherein the clamped value is proportional to the reference current voltage signal;

an output capacitor; and a pass transistor configured to conduct an output current that is proportional to the clamped transconductor current to charge the output capacitor with an output voltage.

14. The LDO regulator of claim 13, wherein the clamped transconductor further includes:

a reference current mirror configured to mirror the reference current into a mirrored reference current;

a second transistor;

a first diode-connected transistor configured to conduct the mirrored reference current through the second transistor;

a third transistor having a gate connected to the first diode-connected transistor; and a fourth transistor in series with the third transistor.

15. The LDO regulator of claim 14, further comprising;

a differential amplifier configured to drive an error signal onto an output node responsive to a difference between a feedback voltage and a reference voltage, wherein the output node is coupled to a gate of the second transistor and to a gate of the third transistor.

16. A method for a low dropout (LDO) regulator, comprising:

generating a bias current proportionally to an output current for the LDO regulator according to a first linear proportionality while the output current is less than a threshold level;

generating the bias current proportionally to the output current according to a second linear proportionality while the output current is greater than the threshold level, wherein the second linear proportionality is less than the first linear proportionality;

conducting a mirrored version of the bias current through a transistor to adjust a variable resistance of a resistor-capacitor (RC) circuit including the transistor; and biasing an output node of a differential amplifier in the LDO regulator with the RC circuit.

17. The method of claim 16, further comprising:

driving the output node of the differential amplifier with an error voltage signal responsive to a difference between a feedback voltage derived from an output voltage for the LDO regulator and a reference voltage.

18. The method of claim 17, further comprising:

transconducting the error voltage signal into a transconductance current;

mirroring the transconductance current through a pass transistor to form the output current; and conducting the output current to an output capacitor to charge the output capacitor with the output voltage.

19. The method of claim 18, further comprising:

clamping the transconductance current at a clamped level.

* * * * *